United States Patent [19]

Eugster

[11] Patent Number: 5,050,851

[45] Date of Patent: Sep. 24, 1991

[54] MACHINE FOR PLACING INSERTS BETWEEN THE PANELS OF FOLDED SHEETS

[75] Inventor: Albert Eugster, Strengelbach, Switzerland

[73] Assignee: GRAPHA-Holding AG, Hergiswil, Switzerland

[21] Appl. No.: 317,737

[22] Filed: Mar. 2, 1989

[30] Foreign Application Priority Data

Mar. 31, 1988 [CH] Switzerland ..... 1236/88

[51] Int. Cl.[5] ..... B65H 5/30

[52] U.S. Cl. ..... 270/55; 270/57

[58] Field of Search ..... 270/54, 55, 57, 58, 270/60

[56] References Cited

U.S. PATENT DOCUMENTS

| | | | |
|---|---|---|---|
| 3,122,362 | 2/1964 | Vollrath | 270/57 |
| 3,269,720 | 8/1966 | Schluckebrier | 270/57 |
| 4,046,367 | 9/1977 | Merker | 270/55 |
| 4,723,770 | 2/1988 | Seidel | 270/55 |
| 4,743,005 | 5/1988 | Reist | 270/55 |

FOREIGN PATENT DOCUMENTS

| | | | |
|---|---|---|---|
| 1044468 | 9/1983 | U.S.S.R. | 270/55 |

*Primary Examiner*—Edward K. Look
*Assistant Examiner*—Therese M. Newholm
*Attorney, Agent, or Firm*—Peter K. Kontler

[57] ABSTRACT

A machine wherein stuffers are inserted between the panels of folded sheets, while the sheets are confined in receptacles advancing along an endless path, has a rotor which defines a portion of the path and supports several sets of sheet opening elements including swords which penetrate between the panels of folded sheets in adjacent receptacles to open up the sheets preparatory to admission of stuffers between the panels. The swords are mounted on a support which is adjustably secured to the rotor so that all of the swords are adjusted relative to the adjacent receptacles in response to proper adjustment of a single sword. This simplifies the change of setup when the machine is to be converted from treatment of folded sheets having relatively thick panels to treatment of folded sheets with thinner panels or vice versa.

21 Claims, 5 Drawing Sheets

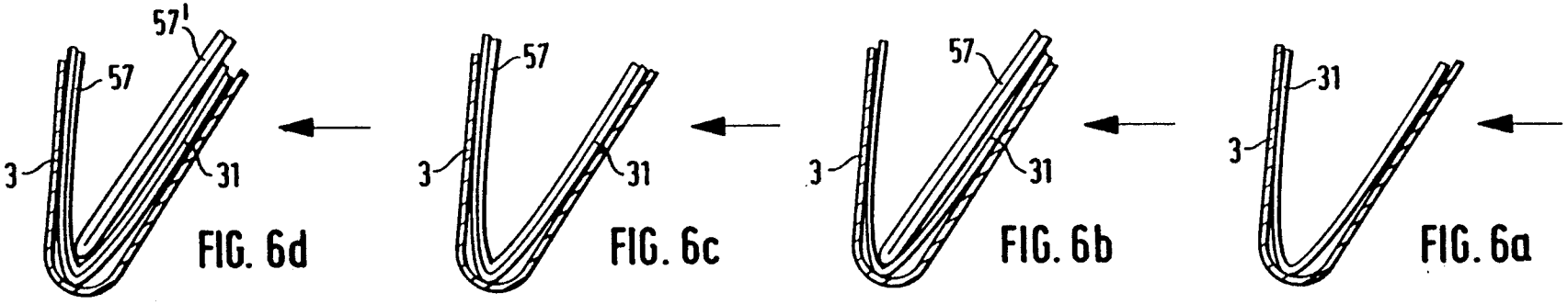
FIG. 6a
FIG. 6b
FIG. 6c
FIG. 6d
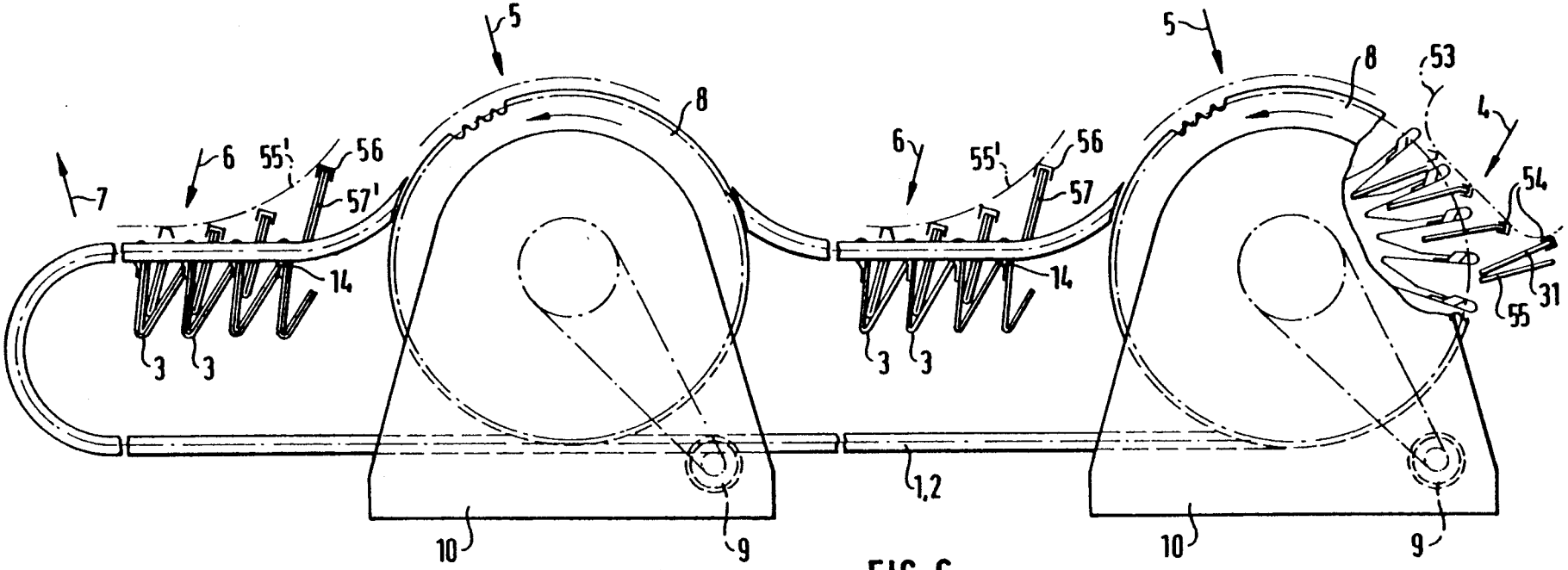
FIG. 6

MACHINE FOR PLACING INSERTS BETWEEN THE PANELS OF FOLDED SHEETS

CROSS-REFERENCE TO RELATED CASES

Machines for inserting stuffers into newspaper jackets are disclosed in commonly owned U.S. Pat. Nos. 4,116,427 (granted Sept. 26, 1978 to Hans Müller for "Apparatus for stuffing newspapers or the like"), U.S. Pat. No. 4,124,203 (granted Nov. 7, 1978 to Hans Müller for "Apparatus for forming sheet material assemblages") and U.S. Pat. No. 4,133,521 (granted Jan. 9, 1979 to Hans Müller for "Sheet material collating apparatus"). The disclosures of the patents to Müller are incorporated herein by reference.

BACKGROUND OF THE INVENTION

The invention relates to improvements in machines for placing inserts (hereinafter called stuffers) between the panels of folded sheets, especially for placing stuffers between the halves of main sections or other sections of newspapers.

Swiss Pat. No. 594 552 discloses a machine wherein a set of pocket-shaped equidistant receptacles is transported along an endless path past a unit which inserts folded sheets into successive receptacles before the receptacles reach an opening station where the inserted sheets are opened, i.e., their panels are pivoted relative to and away from each other preparatory to admission of stuffers into the spaces between the panels of the thus opened sheets. The means for opening the folded sheets comprises a sword-like tool which is caused to penetrate between the panels of a sheet and to pivot the panels in a direction to open up the sheet for reception of a stuffer. The arrangement is such that the sword must be located at a predetermined distance from one wall of the receptacle for the folded sheet which is about to be opened. This ensures that, if one panel overlies the one wall, the sword will penetrate between the panel which overlies or abuts the one wall and the other panel. The patented machine will operate properly only if the receptacles are rigid, if the dimensions of each receptacle match a predetermined norm and if each receptacle invariably assumes a predetermined position in its endless path when the sword is caused to penetrate between the panels of the folded sheet in such receptacle. This cannot be readily achieved if the endless path is relatively long, i.e., if the machine comprises a large number of receptacles. Moreover, and if the machine is to be set up to insert stuffers between folded sheets having panels of different thicknesses, the time for changing the setup is very long because each and every sword must be individually adjusted with reference to the walls of the corresponding receptacle. Furthermore, the number of parts which are necessary to ensure proper adjustment of each individual sword is very large and all this contributes to bulk, complexity and cost of the machine. Thus, it is desirable to provide a machine which can be rapidly converted for the processing of folded sheets having panels of different thicknesses, particularly a machine which can be used to stuff newspapers wherein the thickness of main sections or other sections which are to receive stuffers often changes from day to day.

OBJECTS OF THE INVENTION

An object of the invention is to provide a machine which can properly introduce stuffers between the panels of thick, medium thick or thin folded sheets and wherein the conversion from processing of relatively thick folded sheets to processing of thinner folded sheets or vice versa takes up much less time than in heretofore known machines.

Another object of the invention is to provide the machine with novel and improved means for opening folded sheets in their receptacles.

A further object of the invention is to provide the machine with novel and improved means for supporting the opening means.

An additional object of the invention is to provide the machine with means for inserting two or more stuffers in any desired sequence.

Still another object of the invention is to provide the machine with devices which ensure that each folded sheet assumes a predetermined position relative to the respective receptacle not later than when the contents of such receptacle are to be expelled or otherwise evacuated upon completed insertion of one or more stuffers.

A further object of the invention is to provide a novel and improved method of rapidly changing the setup of the above outlined machine.

Another object of the invention is to provide novel and improved means for adjusting the position of certain parts, particularly of certain parts of the opening means for folded sheets, with reference to the receptacles for folded sheets.

An additional object of the invention is to provide a machine which can be rapidly converted for the processing of folded sheets with thicker or thinner panels irrespective of the number of receptacles for folded sheets.

A further object of the invention is to provide a novel and improved mounting for the swords in a machine of the above outlined character.

Another object of the invention is to provide the machine with novel and improved means for preparing folded sheets in the receptacles for opening by the respective swords.

A further object of the invention is to provide a machine wherein the number of swords need not match the number of receptacles.

An additional object of the invention is to provide the machine with novel and improved means for moving the swords.

SUMMARY OF THE INVENTION

The invention is embodied in a machine for inserting stuffers between the panels of folded sheets, particularly for placing inserts between the panels of sections of newspapers. The improved machine comprises a plurality of preferably equidistant receptacles for folded sheets (each such receptacle can constitute a pocket having an open side for insertion or removal of a folded sheet in such orientation that the back of the folded sheet (e.g., of the main section of a newspaper) comes to rest at the bottom of the receptacle at a location which is remotest from the open side), means for transporting the receptacles in a predetermined direction and at a predetermined speed along an endless path, means for admitting folded sheets into receptacles in a first portion of the path, a stuffer admitting or introducing device which is adjacent a second portion of the path downstream of the first portion, means for opening folded sheets in the receptacles, means for moving the opening means in the predetermined direction and at the predetermined speed along a third portion of the path between the first and second portions, and means for removing or evacuating folded sheets and stuffers from receptacles in a fourth portion of the path downstream of the second portion. The opening means serves to open up the folded sheets in the respective receptacles before such receptacles reach the second portion of the path so that the stuffers can be caused to enter between the spread-out panels of opened folded sheets.

The machine can comprise common prime mover means (e.g., a variable-speed electric or other motor) for the transporting means and the moving means.

The opening means can comprise at least one panel spreading member (e.g., a reciprocable sword) and means for adjusting the spreading member in or counter to the predetermined direction with reference to the receptacles in the path and with reference to the moving means. It is presently preferred, to design the opening means in such a way that it comprises a plurality of panel spreading members, one for each of a plurality of successive receptacles in the third portion of the path. The adjusting means then comprises means for simultaneously adjusting the spreading members in or counter to the predetermined direction with reference to the receptacles in the third portion of the path and with reference to the moving means.

The third portion of the path can have an arcuate shape, preferably a shape forming part of a circle.

The moving means can comprise a rotor, and such rotor can define the third portion of the path (it can also define at least one other portion of the path, for example, the first portion).

The opening means can further comprise means for locating the folded sheets in predetermined positions with reference to the respective receptacles in the third portion of the path. This ensures that each panel spreading member can penetrate between the panels of the thus located folded sheet. The locating means and the panel spreading members of the opening means can be mounted on the rotor.

The machine can further comprise means for aligning the folded sheets in the respective receptacles between the first and fourth portions of the path, preferably adjacent or ahead of the third portion of the path. Such aligning means can comprise means for shifting the sheets (if necessary) relative to the receptacles substantially transversely of the path.

The transporting means can comprise n (e.g., two) endless flexible elements in the form of chains, toothed belts or toothless belts, and the receptacles are then affixed to (e.g., suspended from) such flexible elements. The moving means then preferably comprises n rotary elements, one for each of the flexible elements, and each flexible element is trained over the respective rotary element. The rotary elements together constitute or form part of the aforementioned rotor, and each such rotary element can constitute a sprocket wheel, a toothed pulley or a toothless pulley, depending upon the nature of the flexible elements. The aforementioned prime mover means can drive the flexible elements and the receptacles through the medium of the rotary elements.

The third portion of the path can have a length which is x times y wherein x is the distance between two successive receptacles and y is a whole number exceeding one. In other words, the opening means can comprise discrete panel spreading devices for sheets in a plurality of successive receptacles in the third portion of the path.

The machine can comprise at least one second stuffer admitting device adjacent a fifth portion of the path between the second and fourth portions, at least one second means for opening folded sheets in successive receptacles, and second means for moving the second opening means in the predetermined direction and at the predetermined speed along a sixth portion of the path between the second and fifth portions. Such machine can be used to introduce one or more additional stuffers between the panels of folded sheets before the folded sheets reach the evacuating or removing means at the fourth portion of the path.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIGS. 5, 5A–5C, 6, 6A–6D, are an alternative embodiment having multiple insert stations.

DESCRIPTION OF PREFERRED EMBODIMENTS

Figure 1:
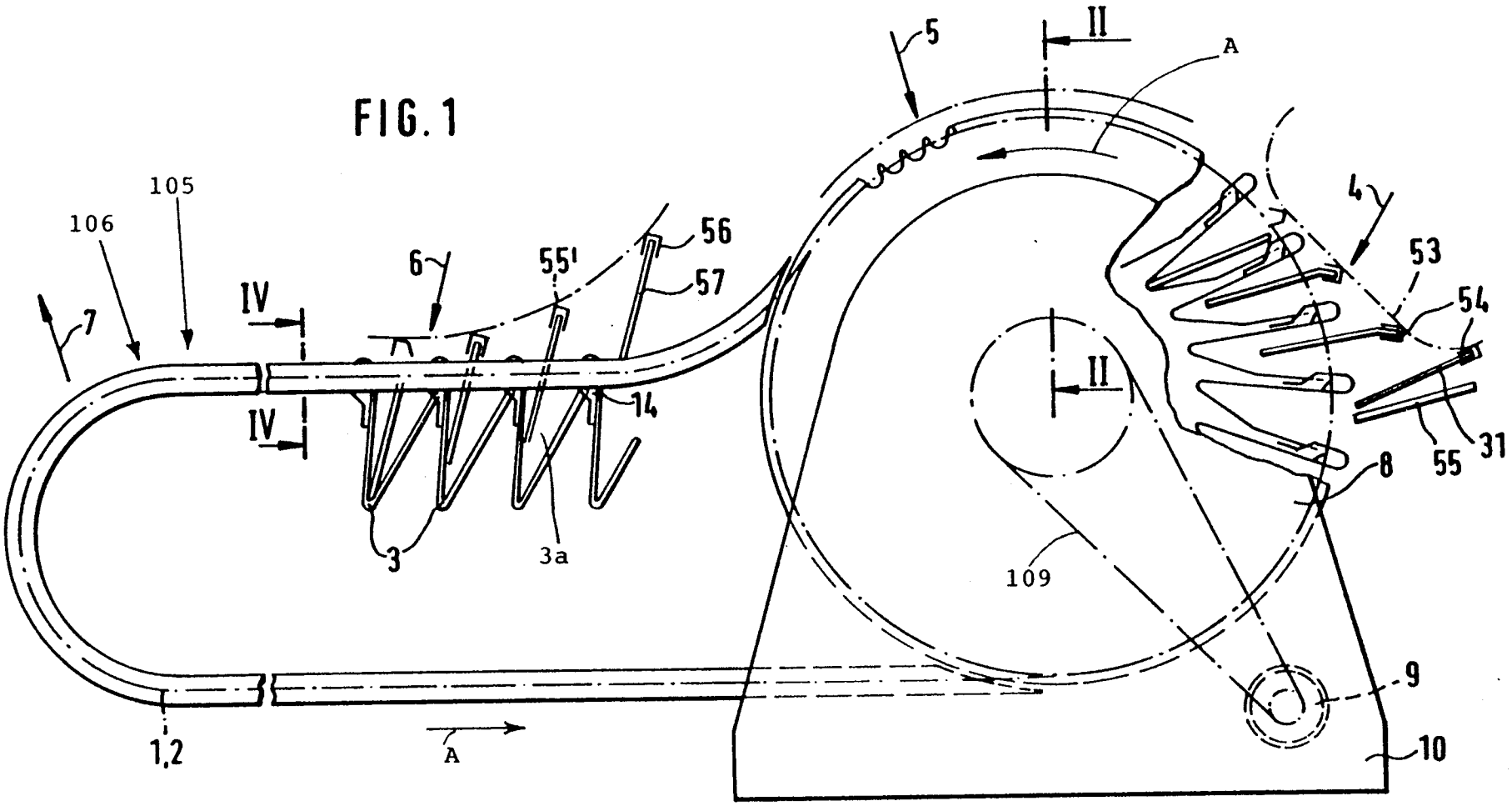
FIG. 1 is a fragmentary schematic elevational view of a machine which embodies one form of the invention, with a portion of the moving means broken away.

The machine which is shown in the drawing serves to insert stuffers 57 between the panels 31*a*, 31*b* (FIG. 3) of folded sheets 31. The machine comprises a plurality of equidistant receptacles 3 in the form of pockets each of which has an open side 3*a* for insertion of folded sheets 31 and stuffers 57 as well as for removal of folded sheets (with stuffers 57 between the panels 31*a*, 31*b* of such sheets), and a closed side 3*b* at the location remotest from the respective open side for the back 31*c* of a properly inserted folded sheet 31. The means for transporting the receptacles 3 along an endless path in the direction of arrows A comprises two endless flexible elements 1 and 2 here shown as chains which are trained over a plurality of rotary elements in the form of sprocket wheels 8, 8*a*. The drawing merely shows two sprocket wheels 8 and 8*a* (FIG. 2) which together form a rotor defining a predetermined arcuate part-circular section of the endless path for the receptacles 3.

A first portion of the endless path is adjacent a station 4 for a unit 53 which serves to admit folded sheets 31 into successive (then empty) receptacles 3. A second portion of the endless path is adjacent a station 6 where a device 55' admits stuffers 57 into the spaces between the panels 31*a*, 31*b* of the (then opened) sheets 31 in successive receptacles 3. A third portion of the endless path is adjacent a station 5 where the sheets 31 in the receptacles 3 are acted upon by opening means (e.g., of the type shown in FIGS. 2 and 3), and a fourth portion of the endless path is adjacent a station 7 where a removing unit of known design evacuates folded sheets 31 and the stuffers 57 between the panels 31*a*, 31*b* of such sheets from successive receptacles 3. The station 6 is located downstream of the station 4 (as seen in the direction of arrows A), the station 5 is located between the stations 4 and 6, and the station 7 is located downstream of the station 6.

The sheet admitting unit 53 can include an endless chain or belt conveyor (a portion of such conveyor is shown in FIG. 1 by phantom lines) which carries a set of equidistant grippers 54 for discrete folded sheets 31. The grippers 54 engage those portions of the panels 31*a*, 31*b* which are remotest from the respective backs 31*c*, and such grippers can be opened by suitable cam and follower means to deposit sheets 31 onto a downwardly sloping ramp 55 which directs the sheets 31 into the oncoming receptacles 3. The conveyor of the unit 54 is driven at the speed of the chains 1 and 2, and successive grippers 54 on this conveyor are opened at a frequency such that each oncoming empty receptacle 3 receives a folded sheet 31 which penetrates into the respective receptacle to assume a position corresponding to that of the rightmost sheet 31 in FIG. 3, i.e., the back 31*c* of the sheet comes to rest at the closed side 3*b* of the respective receptacle 3. The open sides 3*a* of successive receptacles 3 confront the discharge end of the ramp 55 during transport past the station 4.

Figure 2:
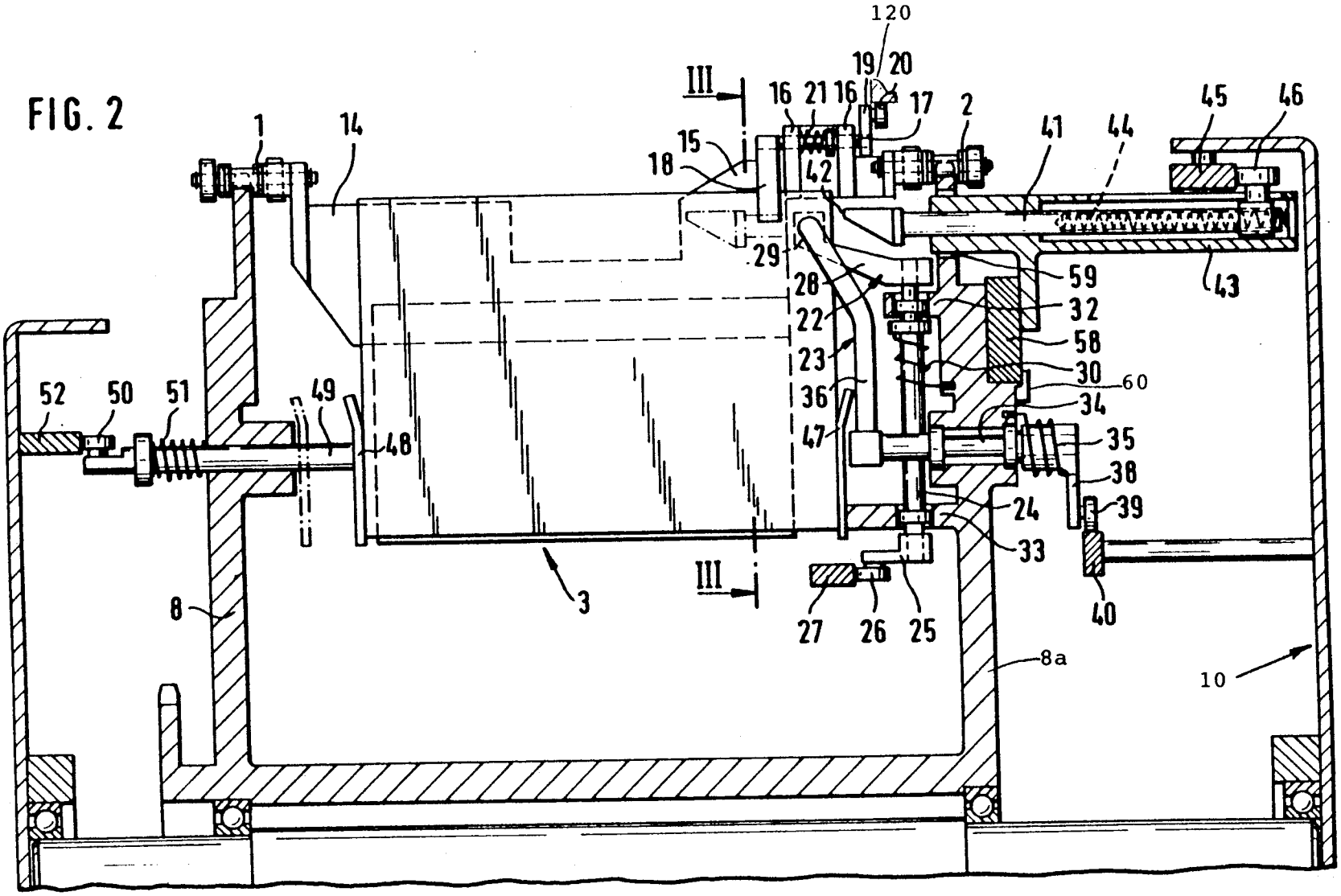
FIG. 2 is an enlarged fragmentary sectional view substantially as seen in the direction of arrows from the line II—II of FIG. 1.
Figure 3:
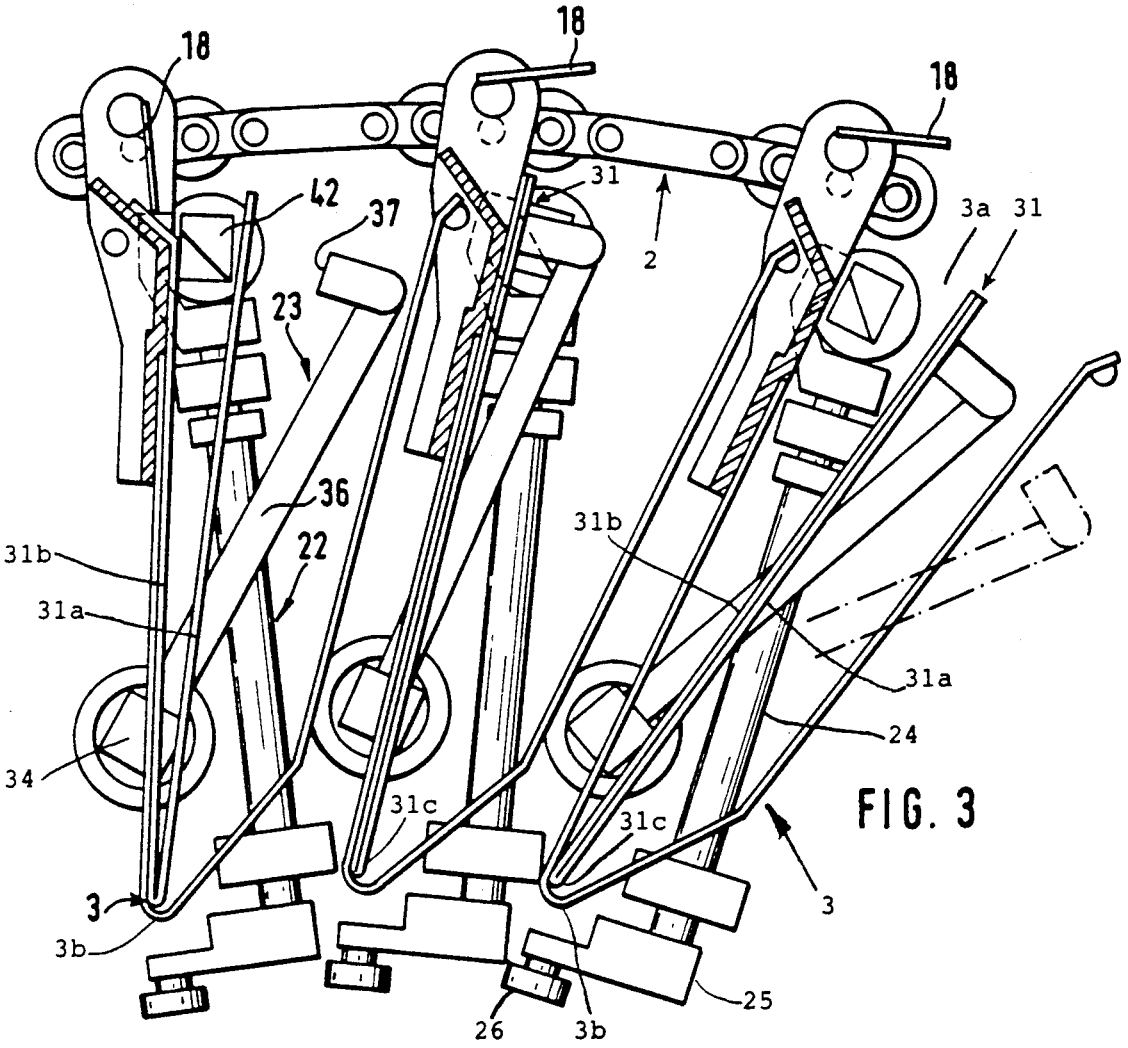
FIG. 3 is an enlarged fragmentary sectional view as seen in the direction of arrows from the line III—III of FIG. 2.

One presently preferred form of means for opening the folded sheets 31 at the station 5 between the stations 4 and 6 is shown in FIGS. 2 and 3. The opening means is mounted on the sprocket wheel 8*a* of the rotor which further includes the sprocket wheel 8 and constitutes a means for moving the opening means at the station 5 in the direction of arrows A at the speed of the chains 1 and 2.

The sprocket wheels 8 and 8*a* are rotatably mounted in a frame 10 and are driven by a prime mover 9 which is installed in or on the frame 10 and transmits torque to the rotor by way of a belt or chain transmission 109. The prime mover 9 drives the chains 1, 2 through the medium of the sprocket wheels 8 and 8*a*. Additional sprocket wheels for the chains 1 and 2 can be installed in the region of the station 7 for the removing unit. If desired, the prime mover 9 (or another prime mover) can drive the additional sprocket wheels so that the chains 1, 2 serve as a means for driving the sprocket wheels 8 and 8*a*. These sprocket wheels define that (part circular) section of the endless path for the chains 1, 2 which includes the path portions adjacent the stations 4 and 5.

Figure 4:
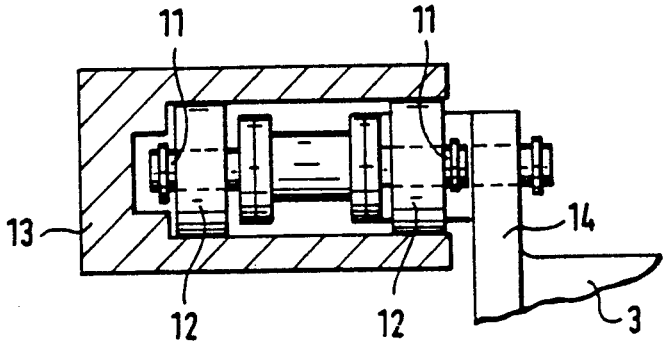
FIG. 4 is an enlarged fragmentary sectional view as seen in the direction of arrows from the line IV—IV of FIG. 1.
Figure 5A:
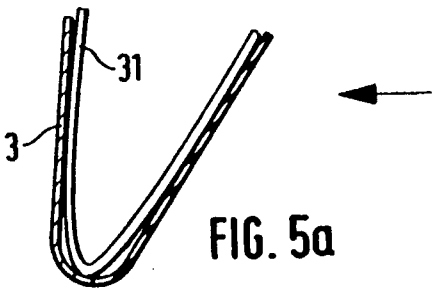
Figure 5B:
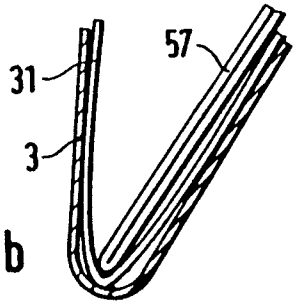
Figure 5C:
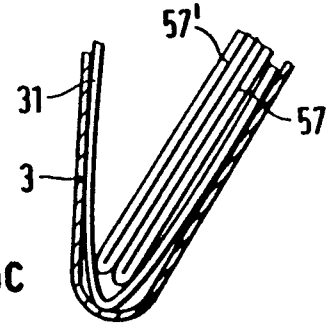
Figure 5:
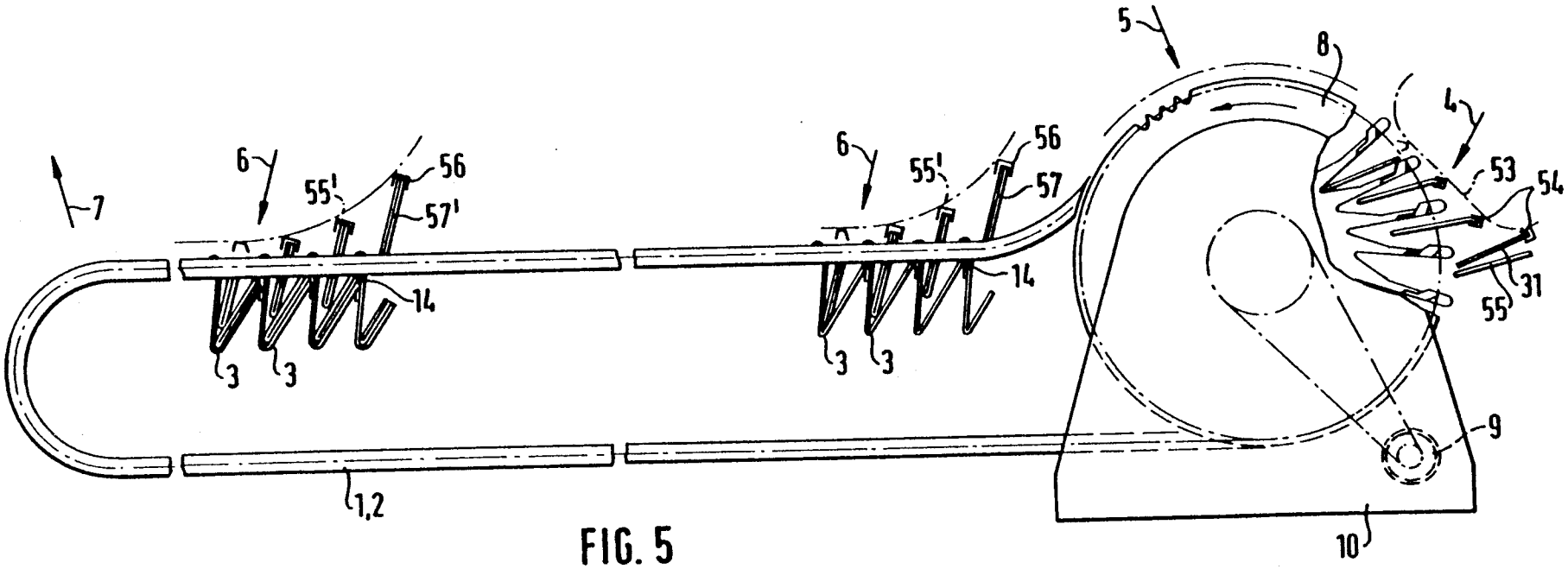

The links of the chains 1 and 2 carry stubs 11 (one shown in FIG. 4) which extend transversely of the endless path and are provided with idler rollers 12 which advance in a stationary guide 13 defining at least that section of the path which extends along the stations 6, 7. The guide 13 can obviate the need for additional sprocket wheels. At the very least, the guide 13 can extend along the straight sections of the endless path for the receptacles 3.

The stubs 11 on the links of the chains 1 and 2 further support carriers 14 and 15 (FIG. 2) for the receptacles 3. The carriers 14 are provided on the stubs 11 of the chain 1, and the carriers 15 are provided on the stubs 11 of the chain 2. The carriers 15 have pairs of rib-shaped bearing elements 16 for shafts 17 which are parallel to the stubs 11. One end portion of each shaft 17 supports a hold-down device 18, and the other end portion of each shaft 17 supports a radially extending lever 19 for a roller follower 20 which tracks a stationary cam 120 to ensure that the hold-down device 18 assumes a predetermined position during travel along a predetermined portion of its endless path about the common axis of the sprocket wheels 8 and 8*a*. More specifically, the followers 20 on the levers 19 of the shafts 17 cooperate with the cam 120 to ensure that the respective hold-down devices 18 are compelled to move between operative positions (note the leftmost hold-down device 18 of FIG. 3) and inoperative positions (note the other two hold-down devices 18 of FIG. 3). Torsion springs 21 act upon the shafts 17 to bias the respective hold-down devices 18 to their inoperative positions. The purpose of the hold-down devices 18 is to engage the adjacent marginal portions of panels 31*b* in the registering receptacles 3 and to flex such marginal portions outwardly in order to ensure that the panels 31*b* are held in predetermined positions preparatory to pivoting of the adjacent panels 31*a* in directions to open the sheets 31 preparatory for admission of stuffers 57.

The opening means on the sprocket wheel 8*a* of the rotor of the means for moving the opening means includes a plurality of groups, one for each of several successive receptacles 3 in the path portion which is adjacent the station 5. Each group includes means for locating the folded sheet 31 in the adjacent receptacle 3 in a predetermined position with reference to such receptacle, and a panel spreading member 41 which moves the trailing panel 31*a* of the properly located sheet 31 away from the leading panel 31*b* by pivoting the panel 31*a* about the hinge which is defined by the respective back 31*c*.

Each locating means comprises an abutment or stop 22 and a holder 23. Each abutment 22 includes a shaft 24 which extends substantially radially of the sprocket wheel 8*a* (at the inner side of this sprocket wheel as seen in FIG. 2). The radially innermost portion of the shaft 24 is journalled in a bearing 33 of the sprocket wheel 8*a* and carries a lever 25 for a roller follower 26 which tracks a stationary cam 27 between the sprocket wheels 8 and 8*a*. The radially outermost portion of the shaft 24 carries an arm 28 for a head 29, and the shaft 24 is acted upon by a torsion spring 30 which maintains the roller follower 26 in engagement with the cam 27. The shaft 24 can turn in the aforementioned bearing 33 and in a second bearing 32 at the inner side of the sprocket wheel 8*a*.

Each holder 23 comprises a shaft 34 which is parallel to the axis of rotation of the sprocket wheel 8*a* and is acted upon by a torsion spring 35 which serves to bias a roller follower 39 at one end of the shaft 34 against a stationary cam 40 in the frame 10. The roller follower 39 is mounted on a lever 38 which extends radially from the outer end of the shaft 34, and the inner end of this shaft carries an arm 36 for a head 37 having a surface adjacent the outer side of the panel 31*a* in the adjacent receptacle 3. The head 37 extends in the circumferential direction of the sprocket wheel 8*a*. A portion of the cam 40 is designed in such a way that the cam compels the head 37 to move toward the head 29 during a certain stage of each orbital movement of the respective shaft 34.

The panel spreading member 41 of each group of the opening means on the sprocket wheel 8*a* is an elongated sword which is reciprocable in a guide 43 on the sprocket wheel 8*a* and includes a wedge-shaped blade 42 serving to penetrate between the panels 31*a*, 31*b* of a sheet 31 in the adjacent receptacle 3 at a time when the panel 31*b* is engaged by the hold-down device 18 of the respective group. This ensures that the blade 42 can penetrate between the panels 31*a*, 31*b* and can pivot the trailing panel 31*a* to a position (note the leftmost sheet 31 of FIG. 3) in which the panels 31*a*, 31*b* provide room for insertion of a stuffer 57 between them. The means for reciprocating the sword 41 in parallelism with the common axis of the sprocket wheels 8 and 8*a* comprises a coil spring 44 which reacts against the guide 43 on the sprocket wheel 8*a* and biases the blade 42 in a direction toward the sprocket wheel 8 (i.e., into the receptacle 3 between the chains 1 and 2), and a roller follower 46 which is mounted at the outer end of the sword 41 and tracks a stationary cam 45 in the frame 10. The extended position of the sword 41 which is shown in FIG. 2 is indicated by phantom lines.

The machine preferably further comprises means for aligning (if necessary) the folded sheets 31 in their receptacles 3 anywhere between the stations 4 and 7, preferably at or close to the station 5, i.e., ahead of the station 6. The purpose of the aligning means is to ensure that the sheets 31 in successive receptacles 3 form a row of accurately aligned sheets each of which is transported at a predetermined distance from each of the sprocket wheels 8 and 8*a* and at a predetermined distance from the chains 1 and 2. The aligning means comprises a plate-like stop 47 at the inner side of the sprocket wheel 8*a*, and a reciprocable plate 48 which is mounted on the sprocket wheel 8 opposite the stop 47. The plate 48 is movable in the axial direction of the sprocket wheels 8 and 8*a* (toward and away from the stop 47) by a pusher 49 which is biased to the left, as seen in FIG. 2, by a coil spring 51 and is provided with a roller follower 50 tracking a stationary cam 52 in the frame 10. The cam 52 causes the plate 48 to move toward the plate 47 at a time when the receptacle 3 between the stop 47 and the plate 48 contains a sheet 31. This ensures that the sheet 31 abuts the stop 47 not later than when the respective receptacle 3 advances beyond the sprocket wheels 8 and 8*a*. The retracted position of the plate 48 is shown in FIG. 2 by phantom lines.

The admitting device 55' comprises an endless chain or belt conveyor (indicated by phantom lines) which carries a set of equidistant grippers 56 for discrete stuffers 57. The means for opening the grippers 57 is designed in such a way that each gripper releases the respective stuffer 57 when the stuffer is certain to descend into the space between the panels 31*a*, 31*b* of the opened sheet 31 in the receptacle 3 advancing along the path portion which is adjacent the station 6.

The means for evacuating sheets 31 and the respective stuffers 57 at the station 7 can be of any conventional design. For example, such means can include a pusher which can expel the contents of successive receptacles 3 by moving transversely of the path of movement of the receptacles, not unlike the plate 48, while it shares the movement of the receptacle 3 in the direction of arrows A.

If the machine is to insert two or more stuffers into the sheets 31 in successive receptacles 3, certain units of the improved apparatus can be duplicated in order to open folded sheets 31 in successive receptacles 3 at a station 105 between the stations 6 and 7, and to insert additional stuffers into the thus opened sheets 31 at a station 106 between the stations 105 and 7. The opening means at the station 105 can be identical or analogous to the opening means at the station 5, and the stuffer admitting device at the station 106 can be identical with or analogous to the stuffer admitting device 55' at the station 6.

In accordance with a further feature of the invention, the machine comprises means for adjusting the swords 41 of the opening means relative to the rotor including the sprocket wheels 8, 8*a* and relative to the receptacles 3 in the path portion at the opening station 5. Such adjustment is desirable and advantageous when the thickness of panels 31*a*, 31*b* forming part of a first series of folded sheets 31 departs from the thickness of panels 31*a*, 31*b* forming part of a second series of folded sheets 31. Heretofore, it was necessary to individually adjust the component parts of the opening means in order to ensure that each folded sheet was properly opened preparatory to admission of a stuffer. This took up much time and necessitated the provision of bulky, complex and expensive means for mounting the component parts of the opening means. For example, the main section of a newspaper is thinner on weekdays than on holidays, or vice versa. Therefore, and if each folded sheet 31 is the main section of a newspaper, it is necessary to adjust the positions of the swords 41 whenever the machine is to process a series of folded sheets which are thicker or thinner than the folded sheets of the preceding series. As a rule, such changes will be made several times during each week and frequently from day to day.

The adjusting means comprises a ring-shaped support 58 which is separably or permanently connected with the guides 43 for all of the swords 41 so that each guide 43 can be moved in the circumferential direction of the sprocket wheel 8*a* prior to being fixed to the sprocket wheel 8*a* in the newly selected angular position. Portions of the guides 43 extend through openings 59 which are provided therefor in the sprocket wheel 8*a*. The dimensions of the openings 59 are selected in such a way that each guide 43 (and the respective sword 41) can be adjusted for proper penetration of the respective blade 42 between the panels 31*a*, 31*b* of the thinnest or thickest folded sheet 31 in the adjacent receptacle 3. The means for releasably securing the support 58 for the guides 43 to the sprocket wheel 8*a* is shown schematically at 60.

It will be seen that adjustment of the support 58 relative to the sprocket wheel 8*a* entails an adjustment of all swords 41 relative to the respective receptacles 3 so that the time which is required to adjust all of the swords 41 relative to the rotor including the sprocket wheels 8, 8*a* and relative to the receptacles 3 between the two sprocket wheels is reduced to a minute fraction of the time which is required to carry out a corresponding adjustment in a conventional machine. In addition, the support 58 ensures that all of the swords 41 are adjusted to the same extent and in the same direction (in or counter to the direction which is indicated by the arrow A). All that is necessary is to loosen the connection between the support 58 and the sprocket wheel 8*a*, to properly select the position of a single sword 41 with reference to the aligned receptacle 3, and to reattach the support 58 to the sprocket wheel 8*a*. This results in automatic adjustment or centering of all other swords 41. Since the support 58 is mounted on the sprocket wheel 8*a*, and the sprocket wheel 8*a* ensures that each receptacle 3 in the space between the sprocket wheels 8 and 8*a* assumes a predetermined position relative to the opening means on the sprocket wheel 8*a*, the number of receptacles 3 which are used in the machine has no bearing on accuracy of adjustment of swords 41 relative to the panels 31*b* of folded sheets 31 in the adjacent receptacles.

The operation is as follows:

Empty receptacles 3 advance from the evacuating station 7 with the lower reaches of the chains 1, 2 toward the rotor which includes the sprocket wheels 8 and 8*a*. The receptacles 3 advance in the direction of arrows A and begin to move along an arcuate section of their path as soon as they reach the six o'clock position of the rotor 8, 8*a*. The followers 46 of successive swords 41 reach a lobe of the cam 45 which causes the corresponding coil springs 44 to store energy as a result of movement of the swords 41 in the respective guides 43 toward retracted positions corresponding to the solid-line position of the sword 41 which is shown in the upper right-hand portion of FIG. 2. The cam 45 need not extend beyond the station 5, or its lobe can be designed in such a way that the springs 44 are free to dissipate energy when the respective swords 41 reach the station 5 so that the blades 42 of such swords can penetrate between the panels 31*a*, 31*b* of folded sheets 31 in the adjacent receptacles 3.

The ramp 55 ensures that each empty receptacle 3 receives a folded (closed) sheet 31 during travel in the path portion extending along the station 4 for the conveyor of the sheet admitting unit 53. The arrangement is preferably such that the ramp 55 properly orients the backs 31*c* of successively delivered sheets 31 and the grippers 54 release such sheets only when the backs 31*c* have penetrated well into the respective receptacles 3.

Successive roller followers 26 and 39 are caused to move the respective stops 22 and holders 23 to operative positions when the adjacent receptacles 3 reach the twelve o'clock position of the rotor including the sprocket wheels 8 and 8*a*. This ensures that the sheets 31 in such receptacles 3 are clamped between the respective heads 29 and 37 to be properly located relative to the blades 42 of the corresponding swords 41 before the springs 44 are free to dissipate energy. The heads 29 and 37 engage the sheets 31 in the regions of open sides 31*a* of the respective receptacles 3. Once the blade 42 of a sword 41 has penetrated between the panels 31*a*, 31*b* in the respective receptacle 3, the panels are parted as soon as the heads 29 and 37 are caused to move apart so that the panels 31*a*, 31*b* provide room for insertion of a stuffer 57. The heads 29 and 37 are caused to reassume their inoperative or retracted positions before the respective receptacles 3 advance beyond the sprocket wheels 8, 8*a* on their way toward the station 6.

The cam 120 thereupon causes successive shafts 17 to pivot the corresponding hold-down devices 18 to the positions corresponding to that of the leftmost hold-down device 18 in FIG. 3 so that the leading panels 31*b* in successive receptacles 3 are clamped to the left-hand walls of such receptacles while the blades 42 of the respective swords 41 are located between the panels. This ensures that the trailing panels 31*a* are caused to pivot relative to the respective leading panels 31*b* and to invariably provide room for insertion of stuffers 57 during travel of receptacles 3 along that portion of their endless path which is adjacent the station 6.

The grippers 56 of the conveyor forming part of the admitting device 55' are caused to open and to release the respective stuffers 57 when the stuffers already extend into the respective receptacles 3, namely at a time when the grippers 56 are closest to the adjacent portions of the chains 1 and 2. This ensures that the stuffers 57 slide all the way to the backs 31*c* of the respective sheets 31 and are properly received between the respective panels 31*a*, 31*b*. The movements of grippers 56 are synchronized with movements of the receptacles 3 at the station 6.

If the sheets 31 are to receive additional stuffers, the opening means at the station 105 are actuated to ensure that each sheet 31 is opened ahead of the station 106 where a second admitting device delivers additional stuffers, e.g., in a manner as shown at 6. If necessary, one or more additional opening stations and one or more additional stuffer admitting devices can be provided between the stations 106 and 7 of FIG. 1.

An important advantage of the improved machine is that its versatility exceeds that of heretofore known machines. Furthermore, the interval of time which is needed to change the setup is a small fraction of the time which is required in conventional machines. In addition, when an adjustment is necessary, all swords 41 are caused to assume optimum positions in response to proper adjustment of a single sword with reference to the moving means (rotor including the sprocket wheels 8, 8*a*) and the receptacles 3 in the path portion adjacent the opening station 5. Still further, the accuracy of adjustment of swords 41 relative to the adjacent receptacles 3 is not dependent upon the overall number of receptacles, i.e., upon the length of the chains 1 and 2 and of the path which is defined by such chains in conjunction with the rotor including the sprocket wheels 8 and 8*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should are intended to be comprehended within the meaning and range of equivalence of the appended claims.

I claim:

1. Machine for inserting stuffers between the panels of folded sheets, particularly for placing inserts between the panels of newspapers, comprising a plurality of equidistant receptacles for folded sheets; means for transporting said receptacles in a predetermined direction and at a predetermined speed along an endless path; means for admitting folded sheets into receptacles in a first portion of said path; a stuffer admitting device adjacent a second portion of said path downstream of said first portion; means for opening folded sheets in said receptacles; means for moving said opening means in said direction and at said predetermined speed only along a third portion of said path between said first and second portions; and means for removing folded sheets and stuffers from receptacles in a fourth portion of said path downstream of said second portion.

2. The machine of claim 1, further comprising common prime mover means for said transporting means and said moving means.

3. The machine of claim 1, further comprising a second stuffer admitting device adjacent a fifth portion of said path between said second and fourth portions, second means for opening folded sheets in successive receptacles, and second means for moving said second opening means in said direction at said predetermined speed along a sixth portion of said path between said second and fifth portions.

4. The machine of claim 1, wherein the third portion of said path has an arcuate shape.

5. The machine of claim 1, wherein said moving means comprises a rotor.

6. The machine of claim 5, wherein said rotor defines said third portion of said path.

7. The machine of claim 1, wherein said opening means includes means for locating the folded sheets in predetermined positions with reference to the respective receptacles in the third portion of said path, and panel spreading members for the thus located sheets in the third portion of said path.

8. The machine of claim 1, further comprising means for aligning the folded sheets in the respective receptacles between the first and fourth portions of said path.

9. The machine of claim 8, wherein said aligning means comprises means for shifting the sheets relative to the receptacles substantially transversely of said direction.

10. The machine of claim 8, wherein said aligning means is adjacent the third portion of said path.

11. The machine of claim 8, wherein said aligning means is located ahead of the third portion of said path.

12. The machine of claim 1, wherein said third portion of said path has a length x times y wherein x is the distance between two receptacles and y is a whole number exceeding one.

13. The machine of claim 1, wherein said opening means includes discrete panel spreading devices for sheets in a plurality of successive receptacles in the third portion of said path.

14. Machine for inserting stuffers between the panels of folded sheets, particularly for placing inserts between the panels of newspapers, comprising a plurality of equidistant receptacles for folded sheets; means for transporting said receptacles in a predetermined direction and at a predetermined speed along an endless path; means for admitting folded sheets into receptacles in a first portion of said path; a stuffer admitting device adjacent a second portion of said path downstream of said first portion; means for opening folded sheets in said receptacles; means for moving said opening means in said direction and at said predetermined speed along a third portion of said path between said first and second portions; and means for removing folded sheets and stuffers from receptacles in a fourth portion of said path downstream of said second portion, said opening means including at least one panel spreading member and means for adjusting said spreading member in or counter to said direction with reference to the receptacles in said path and with reference to said moving means.

15. The machine of claim 14, wherein said opening means includes a plurality of discrete panel spreading members, one for each of a plurality of successive receptacles in the third portion of said path, said adjusting means comprising means for simultaneously adjusting said spreading members in or counter to said direction with reference to the receptacles in the third portion of said path and with reference to said moving means.

16. The machine of claim 14, wherein said third portion of said path has an arcuate shape.

17. Machine for inserting stuffers between the panels of folded sheets, particularly for placing inserts between the panels of newspapers, comprising a plurality of equidistant receptacles for folded sheets; means for transporting said receptacles in a predetermined direction and at a predetermined speed along an endless path; means for admitting folded sheets into receptacles in a first portion of said path; a stuffer admitting device adjacent a second portion of said path downstream of said first portion; means for opening folded sheets in said receptacles, including means for locating the folded sheets in predetermined positions with reference to the respective receptacles in the third portion of said path, and panel spreading members for the thus located sheets in the third portion of said path; means for moving said opening means in said direction and said predetermined speed along a third portion of said path between said first and second portions, said moving means comprising a rotor and means for mounting said locating means and said spreading members on said rotor; and means for removing folded sheets and stuffers from receptacles in a fourth portion of said path downstream of said second portion.

18. Machine for inserting stuffers between the panels of folded sheets, particularly for placing inserts between the panels of newspapers; comprising a plurality of equidistant receptacles for folded sheets; means for transporting said receptacles in a predetermined direction and at a predetermined speed along an endless path, said transporting means comprising n endless flexible elements and said receptacles being affixed to said flexible elements; means for admitting folded sheets into receptacles in a first portion of said path; a stuffer admitting device adjacent a second portion of said path downstream of said first portion; means for opening folded sheets in said receptacles; means for moving said opening means in said direction and at said predetermined speed along a third portion of said path between said first and second portions, said moving means comprising n rotary elements, one for each of said flexible elements, and each flexible element being trained over the respective rotary element; and means for removing folded sheets and stuffers from receptacles in a fourth portion of said path downstream of said second portion.

19. The machine of claim 18, wherein said flexible elements are chains and said rotary elements are sprocket wheels.

20. The machine of claim 18, further comprising means for driving said flexible elements through the medium of said rotary elements.

21. The machine of claim 18, wherein said flexible elements are belts and said rotary elements are pulleys.

* * * * *